US006811835B1

(12) United States Patent
Parietti

(10) Patent No.: US 6,811,835 B1
(45) Date of Patent: Nov. 2, 2004

(54) LICHEN ON ROCK CAMOUFLAGE PATTERN

(76) Inventor: Michael I. Parietti, 1200 N. Veitch St. #1606, Arlington, VA (US) 22201

( * ) Notice: Subject to any disclaimer, the term of this patent is extended or adjusted under 35 U.S.C. 154(b) by 42 days.

(21) Appl. No.: 10/165,313

(22) Filed: Jun. 10, 2002

(51) Int. Cl.[7] ..... A41G 1/00
(52) U.S. Cl. ..... 428/17; 428/919; 428/15
(58) Field of Search ..... 428/15, 17, 919

(56) References Cited

U.S. PATENT DOCUMENTS 4,656,065 A * 4/1987 Yacovella
5,066,529 A * 11/1991 Huber et al.
5,778,590 A * 7/1998 Browning et al.

* cited by examiner

*Primary Examiner*—Stephen Stein
*Assistant Examiner*—Wendy Boss

(57) ABSTRACT

A camouflage pattern for use on clothing and other articles for concealing a hunter or outdoorsman in a wilderness area where there are rocks and boulders with lichen formations growing on them. This camouflage pattern would be useful for outdoorsmen, photographers, and hunters that hide behind or amongst rocks, perch on top of boulders or conduct their activities in areas where lichen covered rocks are found. The pattern is comprised of a background of gray, slate or black. This background can be either of a uniform shade of black, slate or gray, or of a variety of different shades, and is overlaid by a foreground pattern of lichen formations of growths. The lichen patterns are comprised of repeating or random arrangements of circular oval, ring or doughnut shaped lichen growths being of one or more varying shades of green, gray, blue, white, and black. As lichen pattern and formations in nature can be uniform or repeating, or entirely random and the lichen growths can be arranged in almost any way what so ever, so the design of this lichen camouflage pattern could be repeating or random as well. The lichen growths can be of many different sizes from just fractions of an inch long or wide to many inches long or wide.

2 Claims, 12 Drawing Sheets

LICHEN ON ROCK CAMOUFLAGE PATTERN

FIELD OF THE INVENTION

The present invention generally relates to the field of camouflage patterns and, more particularly it relates to an improved camouflage pattern for use on outdoorsman's clothing and other articles, which incorporate a foreground pattern of lichen growths and formations, and a gray or black background to simulate a rock or boulder with naturally occurring lichens growing on it.

BACKGROUND OF THE INVENTION

Over the years a variety of camouflage design patterns have been utilized to improve the concealment techniques utilized by hunters, birdwatchers, photographers and others engaged in outdoor activities.

These design include such things as camouflage patterns designed to mimic the natural pattern of tree bark as in U.S. Pat. No. 4,656,065 to Yacovella, or palmetto branches as in U.S. Pat. No. 5,753,323 Andrus, or tree leaves such as U.S. Pat. No. 4,865,900 or even specific types of tree leaves such as oak or pine.

BRIEF SUMMARY OF THE INVENTION

The aforementioned designs do not address the need for a camouflage pattern for use in the rock and boulder strewn forests, mountains and wilderness areas found throughout the country but in particular in the Appalachian mountain range. The rocks and boulders in these areas typically are dotted with lichen growths and formations. Many outdoorsman and hunters prefer to conduct their activities around, behind and perched on top of these rocks and boulders. This camouflage pattern will make it easier for outdoorsmen to remain concealed and unnoticed when around and on top of these rocks. An important advantage of this lichen camouflage is that it is not seasonal as many types of leaf camouflage are. The lichen camouflage will be effective whether the leaves are on the trees or not, and whether it is spring or fall.

DETAILED DESCRIPTION OF THE PREFERRED EMBODIMENT

Figure 1:
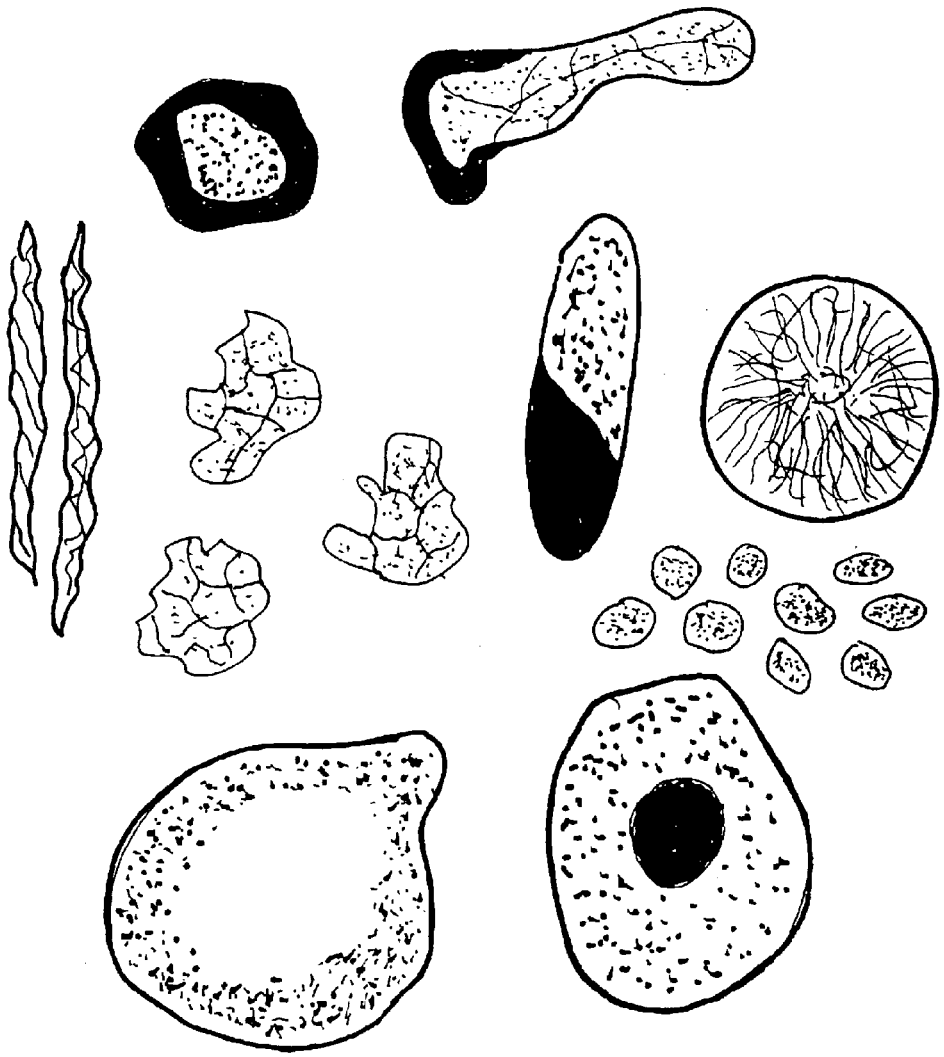
FIG. 1 is one possible embodiment of the lichen on rock camouflage pattern with an irregular or non uniform pattern or arrangement of the lichen growths or formations. This shows that unique and distinct lichen growths are mixed together to form a larger random arrangement or pattern as sometimes occurs in nature and the wild.
Figure 2:
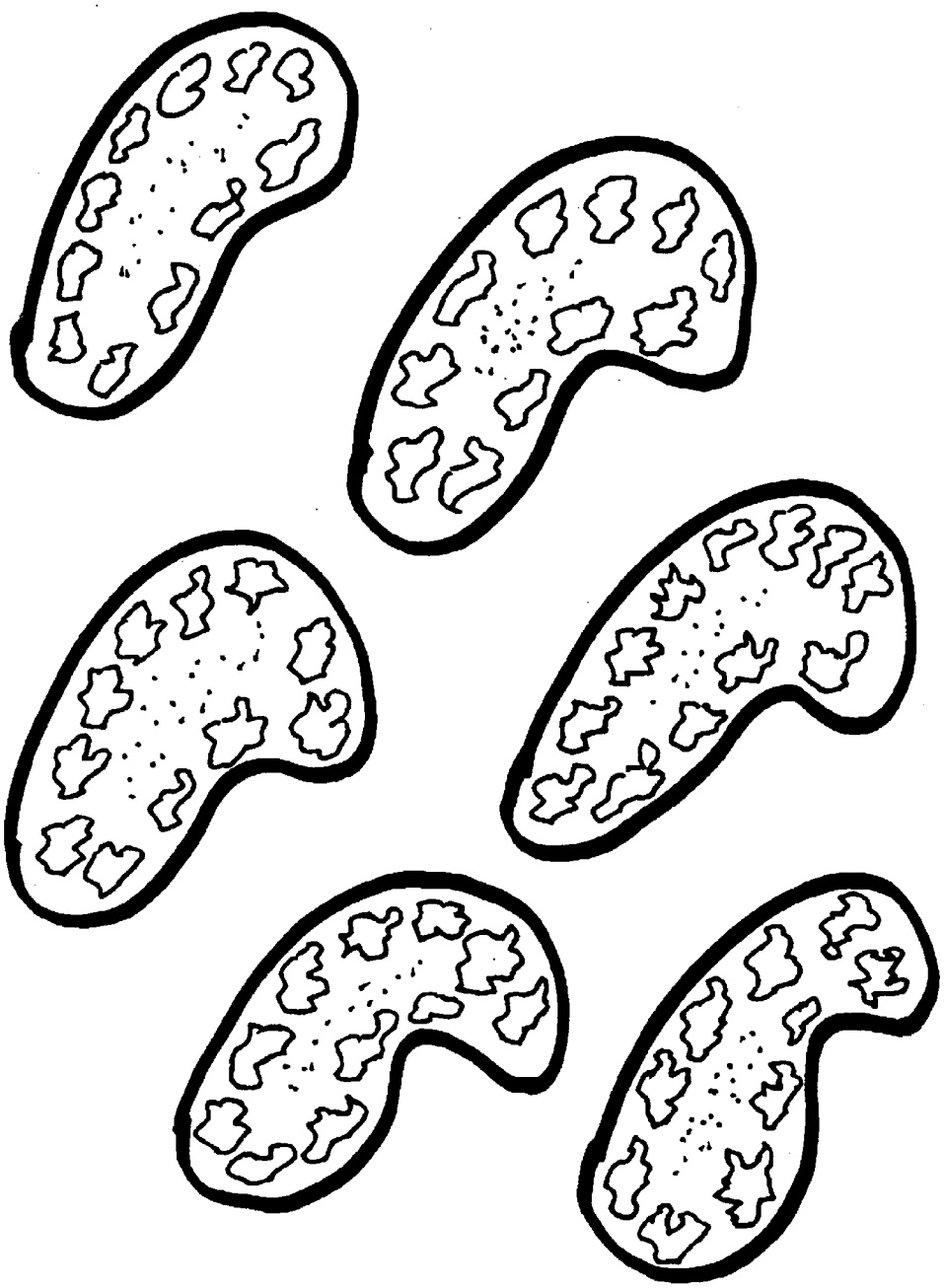
FIG. 2 is one possible embodiment of the lichen on rock camouflage pattern with a more regular or uniform pattern or arrangement of the lichen growths or formations. This shows that the lichen growths are very similar in appearance to each other and are arranged in a regular or repeating pattern.
Figure 3:
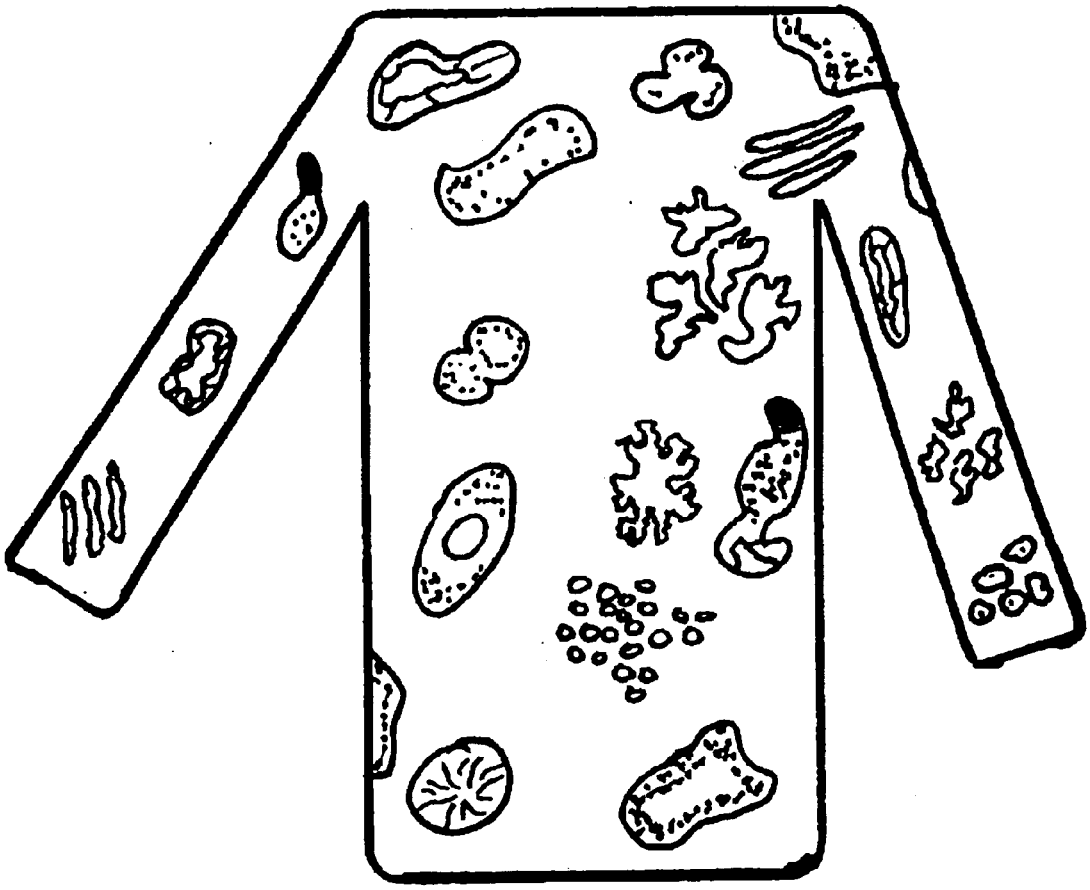
FIG. 3 is the rear view of a blouse or jacket made of camouflage cloth covered with one possible embodiment of the invention of the lichen on rock camouflage pattern with an irregular or non uniform pattern or arrangement of the lichen growths or formations.
Figure 4:
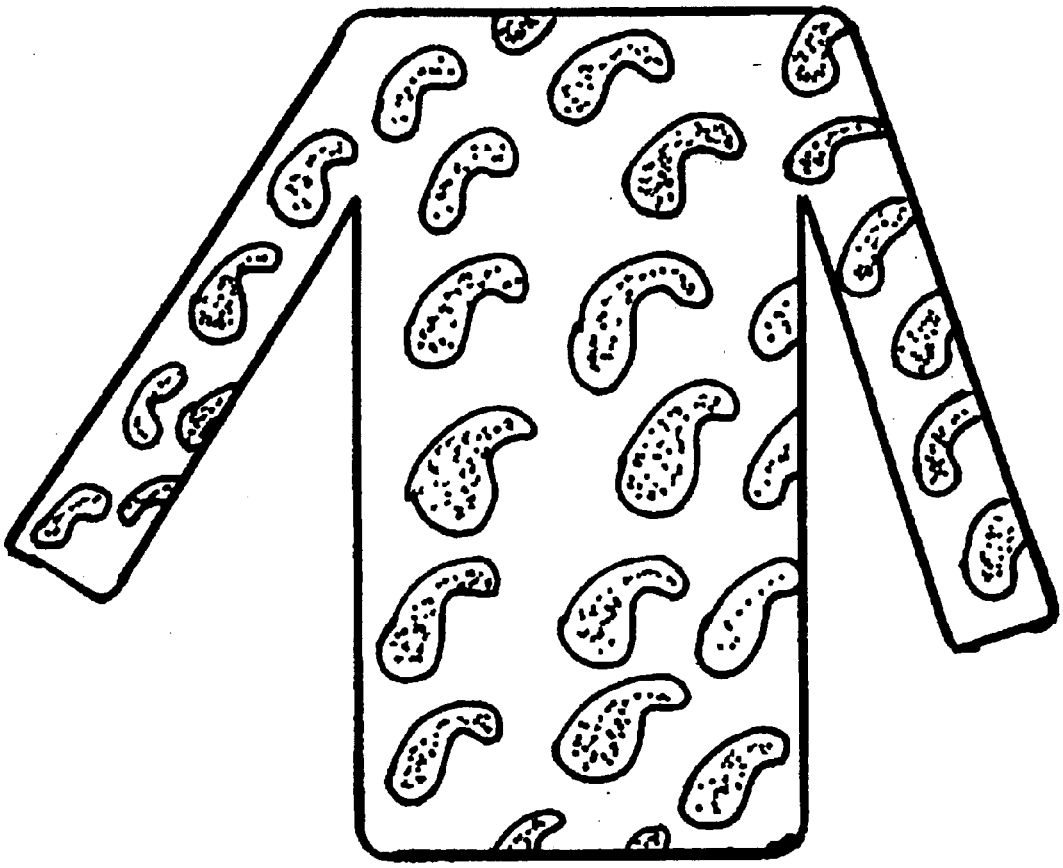
FIG. 4 is the rear view of a blouse or jacket made of camouflage cloth covered with one possible embodiment of the invention of the lichen on rock camouflage pattern with a more regular, uniform or repeating pattern or arrangement of the lichen growths or formations.
Figure 5:
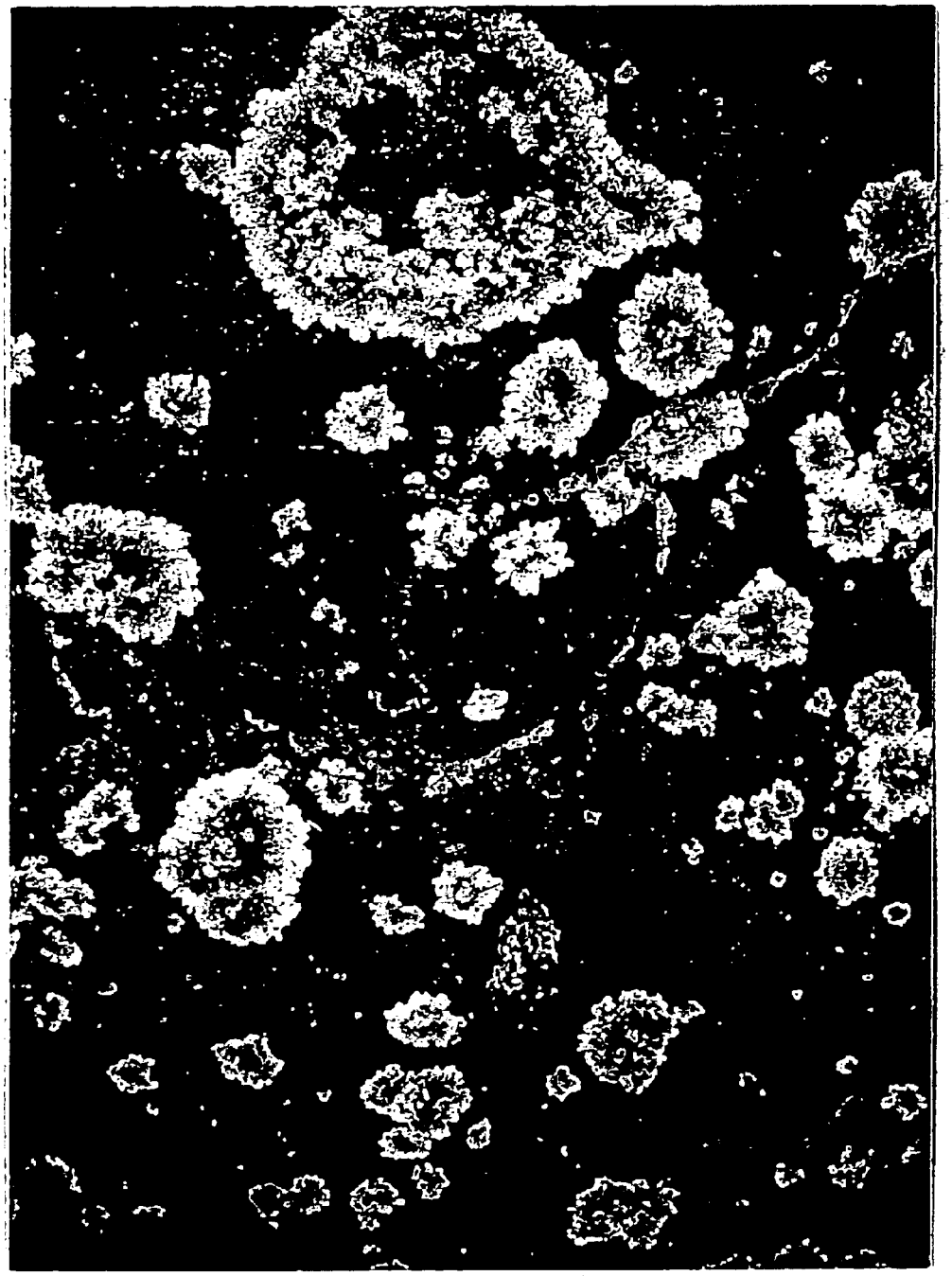
FIG. 5 is another possible embodiment of the lichen on rock camouflage pattern.
Figure 6:
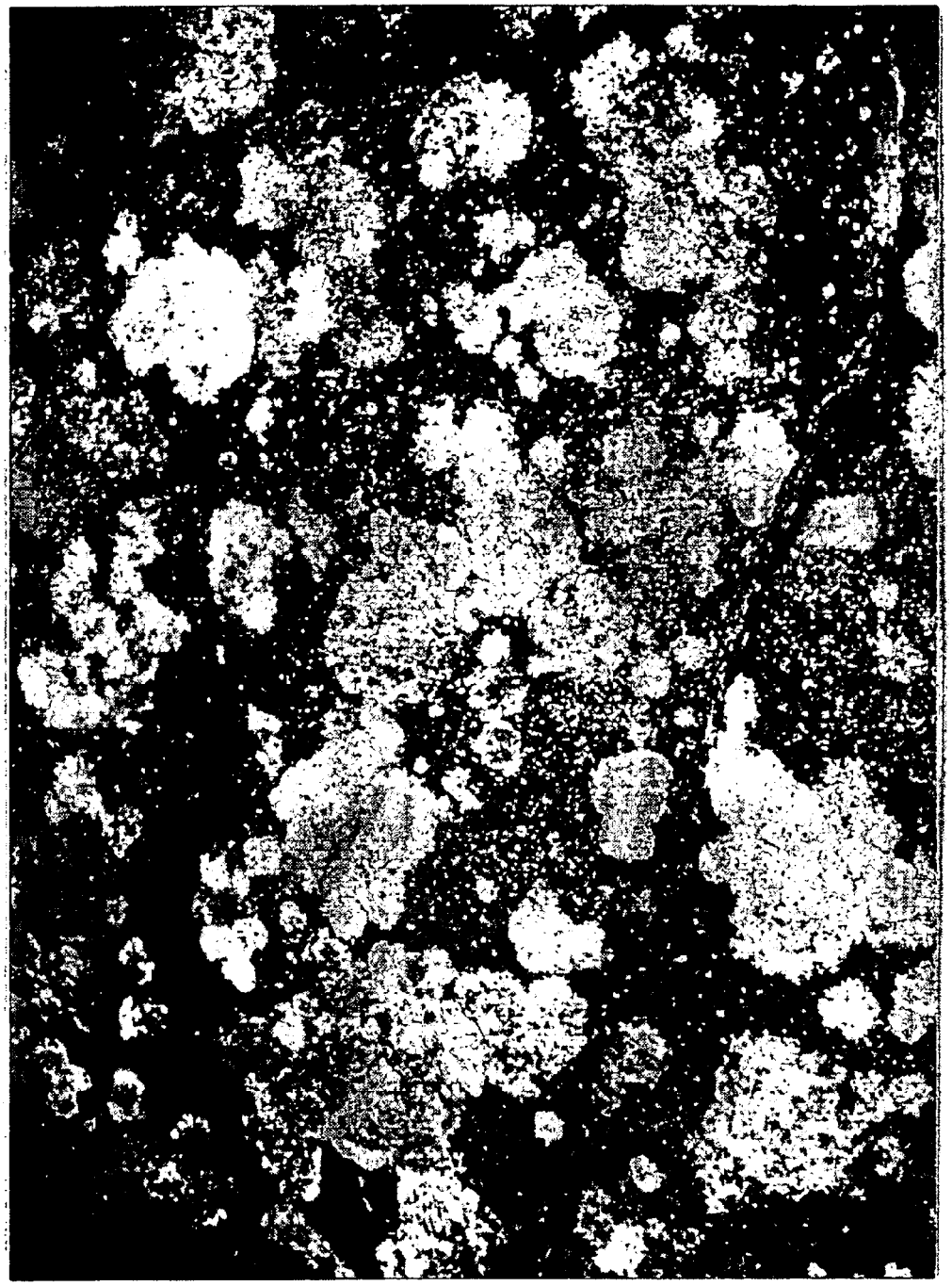
FIG. 6 is another possible embodiment of the lichen on rock camouflage pattern.
Figure 7:
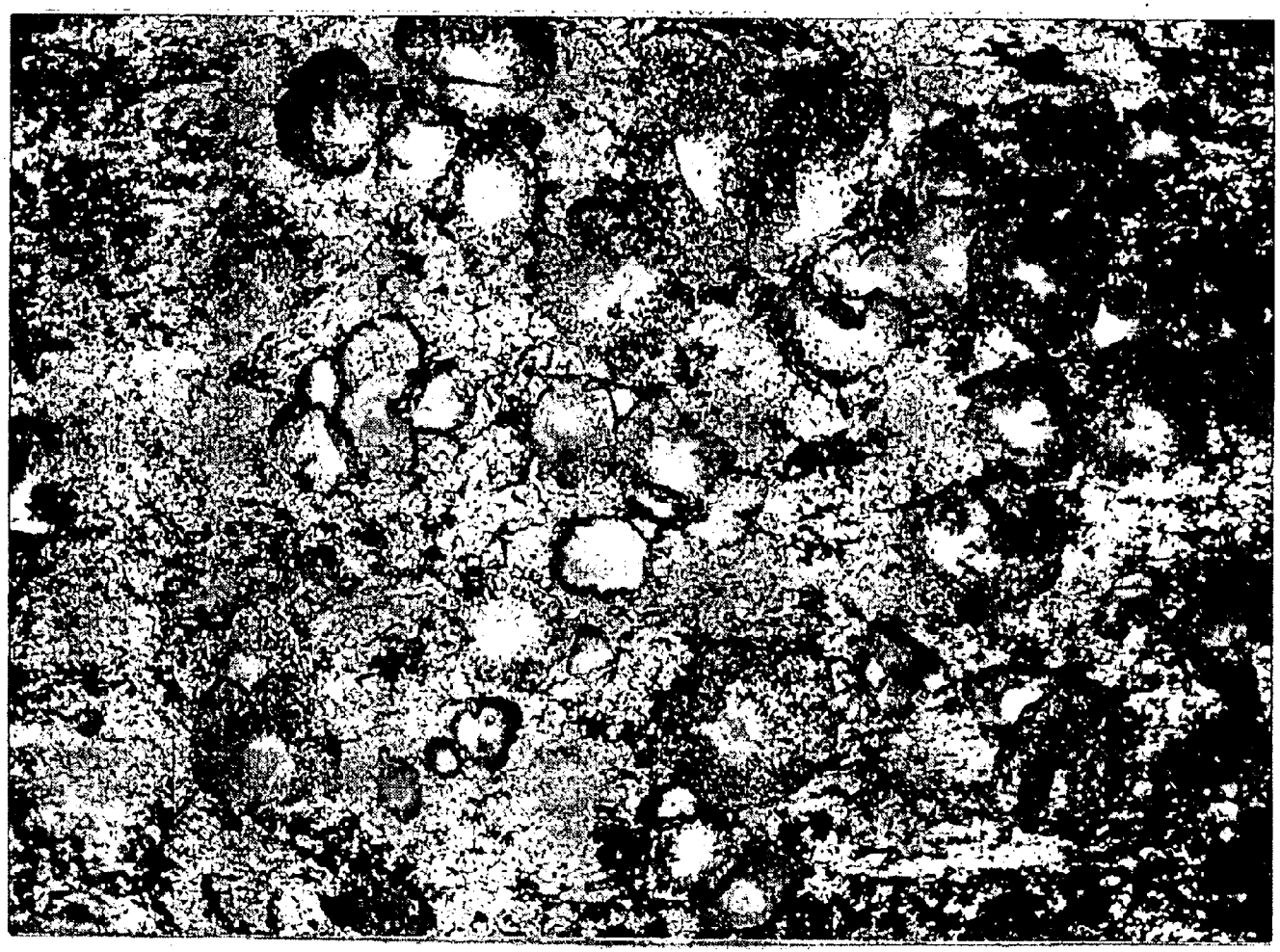
FIG. 7 is another possible embodiment of the lichen on rock camouflage pattern.
Figure 8:
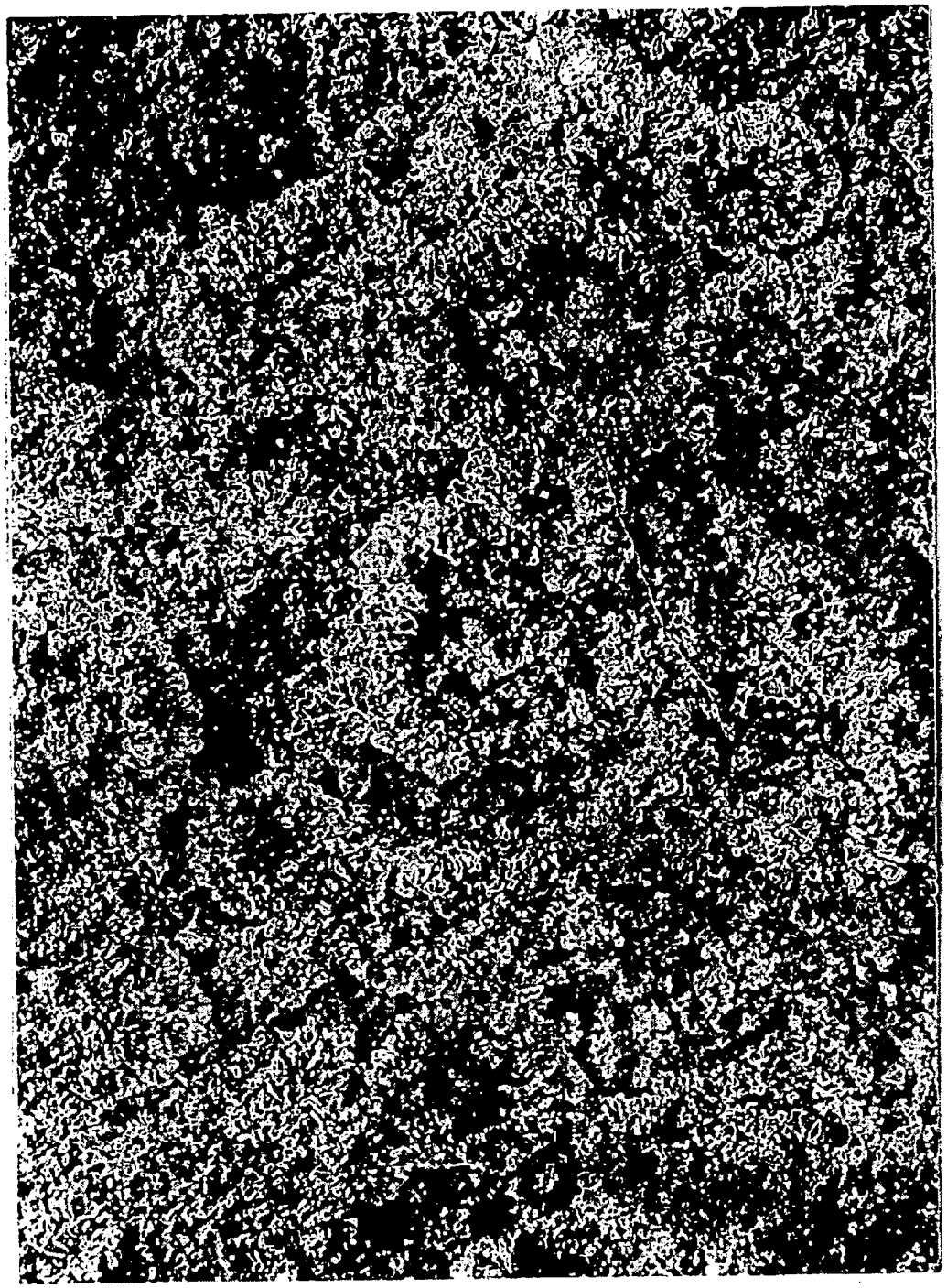
FIG. 8 is another possible embodiment of the lichen on rock camouflage pattern.
Figure 9:
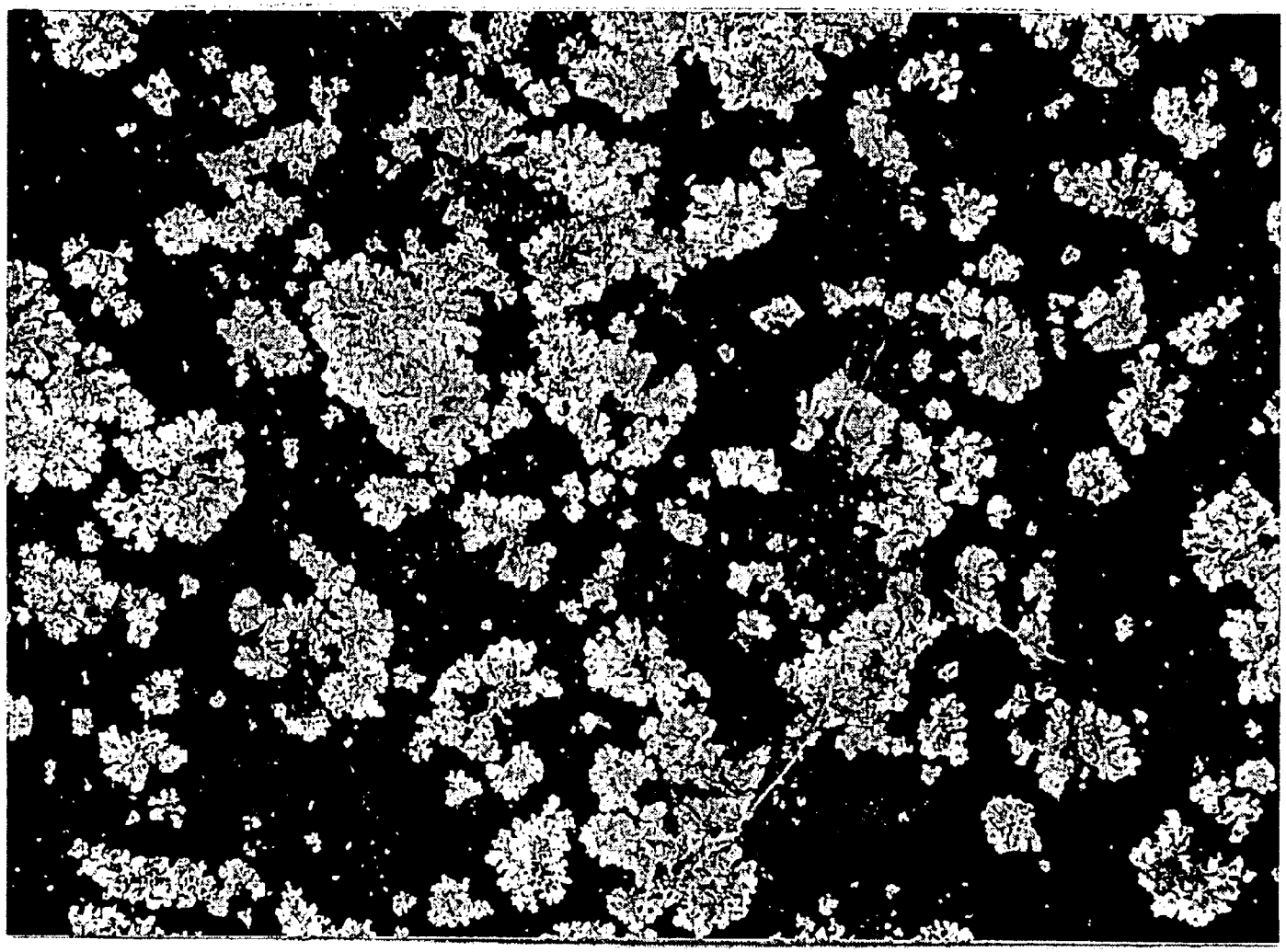
FIG. 9 is another possible embodiment of the lichen on rock camouflage pattern.
Figure 10:
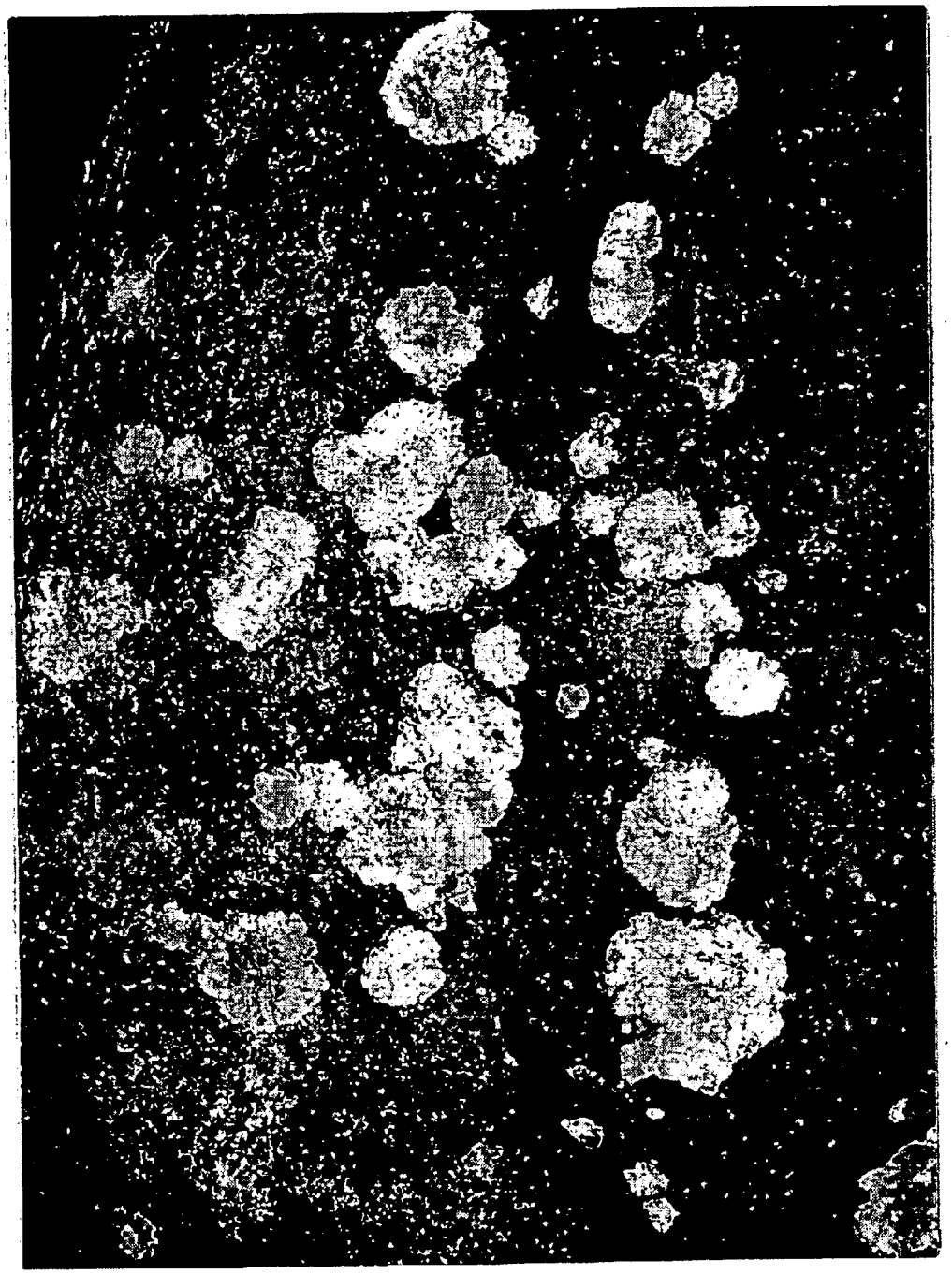
FIG. 10 is another possible embodiment of the lichen on rock camouflage pattern.
Figure 11:
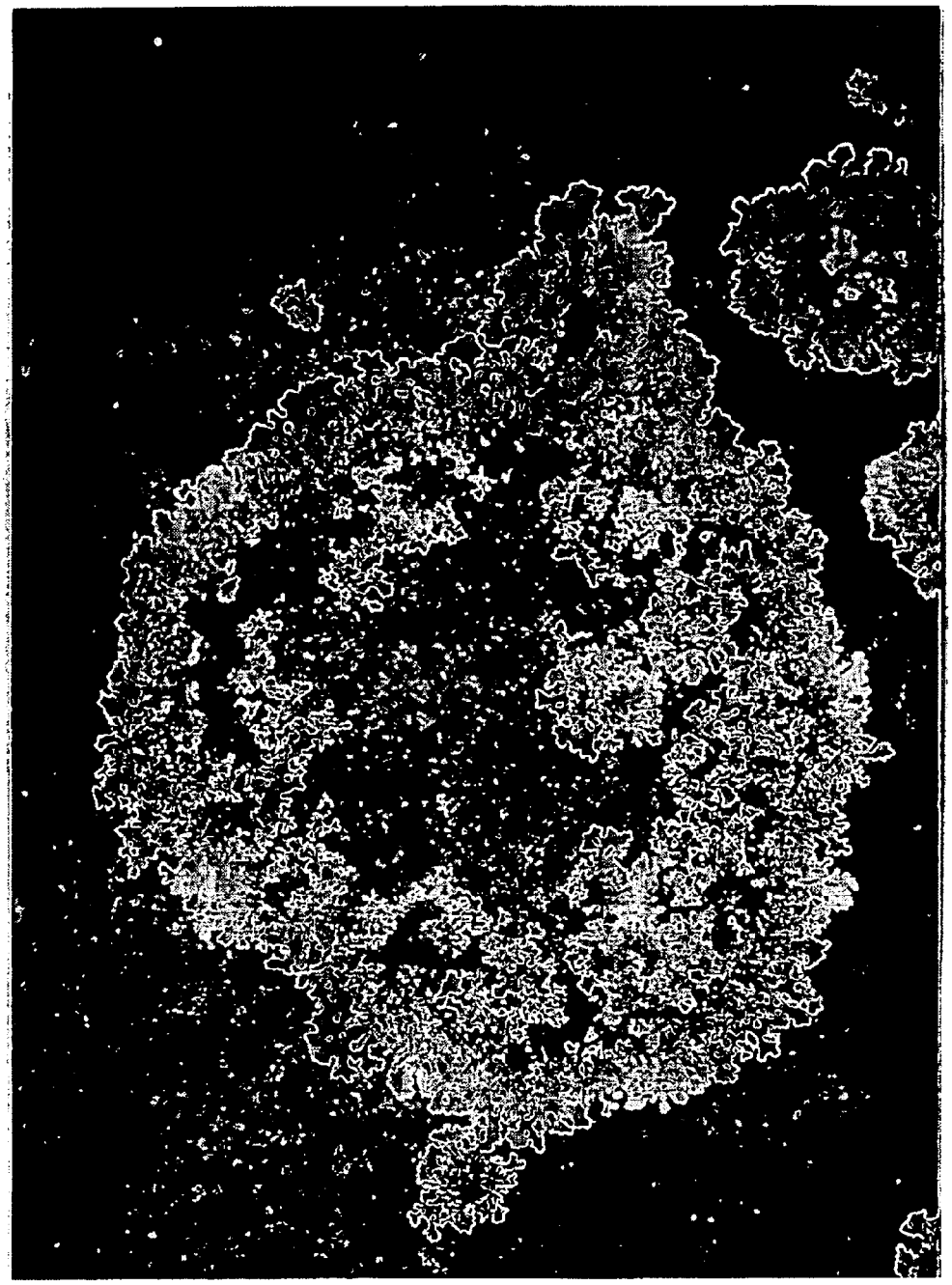
FIG. 11 is a close up view of a single lichen growth with a ring like, doughnut shaped or hollow presentation that could make up a part of a target camouflage pattern, either uniform with multiple copies of a similar design at this one, or of a random pattern that includes other lichens growths of different or distinct designs or appearances.
Figure 12:
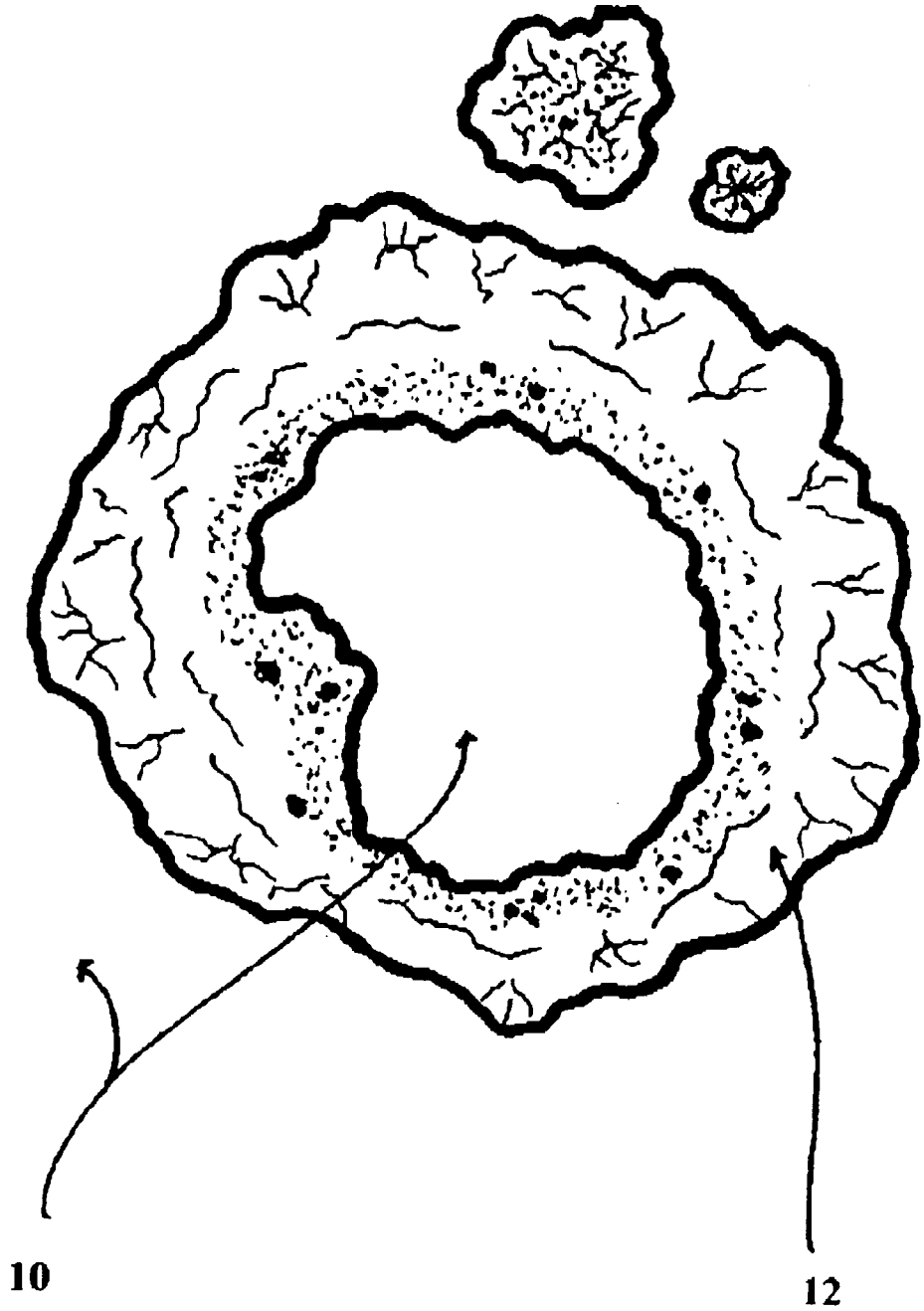
FIG. 12 is a close up view of another possible embodiment of a single lichen growth with a ring like, doughnut shaped or hollow presentation that could make up a part of a larger camouflage pattern, either uniform with multiple copies of a similar design as this one, or of a random pattern that includes other lichen growths of different or distinct designs or appearances.

The camouflage pattern shown in FIGS. 1 thru 11, have a background (10) of varying shades of gray and black, with a foreground of lichen growths or formations (12) of one or more varying shades of colors, including but not limited to green, blue, gray, white or black are appropriately circular, oval, ring or doughnut shaped or hollow in appearance. These lichen growths sometimes overlap each other or touch each other tangentially and have a variety of different markings to show texture, including striations, speckles or splotches. The lichen growths or formations assume any number of different arrangements or patterns in relation to each other, sometimes random arrangements, and sometimes a uniform, regular or repeating pattern. The lichen growths are many different sizes from just fractions of an inch long or wide to many inches long or wide. The above mentioned characteristics mimic the natural appearance of lichen growths or formations found in the wild.

If the outdoorsman in conducting his activities in wilderness area strewn with rocks and boulders, as much of the Appalachian Mountains are, if he is standing, sitting, or laying amongst, near or on top or the boulders and rocks, this camouflage pattern will enable him to blend in with the natural surroundings, and provide him with concealment. This camouflage pattern can be used on any article for which camouflage is desirable.

While the invention has been described hereinabove with respect to a preferred embodiment, it should be understood that the invention is not limited to that precise embodiment, and that many modifications and variations thereof would present themselves to those skilled in the art without departure from the scope and spirit of this invention, as defined in the appended claims. It is thought that the camouflage concept of the present invention and many of it's attendant advantages will be understood from the foregoing description and it will be apparent that various changes many be made in the form, construction, an arrangement of the parts thereof without departing from the spirit and scope of the invention or sacrificing all of its material advantages, the form described herein being merely a preferred or exemplary embodiment of the invention.

I claim:

1. A camouflage material comprising, a) a background of any shade of gray or black, from light gray to slate gray, to charcoal black, said background being a uniform shade of gray or black or having varying shades of gray or black, b) a foreground pattern with a plurality of lichen growths or formations overlaying said gray background, said lichen formations being approximately circular, oval, ring, or doughnut shaped, or hollow in appearance, , said lichen growths sometimes overlapping each other or touching each other tangentially, said lichen growths having a variety of different markings to show texture, including striations, speckles or splotches said lichen growths or formations assuming any number of different arrangements or patterns in relation to each other, some with random arrangements, and some with a uniform, regular or repeating pattern, said lichen growths or formations being of one or more varying shades of green, gray, blue, white, and black, said lichen growths being of many different sizes from just fractions of an inch long or wide to many inches long or wide, wherein the material is configured to mimic rocks or boulders with lichen growths or formations upon them.

2. A camouflage material for use on clothing or other articles for concealing a hunter, photographer or outdoorsman in a wilderness area that has rocks and boulders with lichen growths and formations upon them, consisting of:

a) a contiguous background of any shade of gray or black, from light gray to slate gray, to charcoal black, said background being a uniform shade of gray or black or having varying shades or gray or black, b) a foreground pattern with a plurality of lichen growths or formations overlaying said gray background, said lichen formations of said foreground being approximately circular, oval, ring or doughnut shaped or hollow in appearance, said lichen growths sometimes overlapping each other or touching each other tangentially, said lichen growths having a variety of different markings to show texture, including striations, speckles or splotches, said lichen growths or formations assuming any number of different arrangements or patterns in relation to each other, some with random arrangements, and some with a uniform, regular or repeating pattern, and said lichen growths or formations being of one or more varying shades of green, gray, blue, white and black, said lichen growths being of many different sizes from just fractions of an inch long or wide to many inches long or wide, wherein the material is configured to mimic rocks or boulders with lichen growths or formations upon them.

* * * * *